United States Patent [19]

Bocca et al.

[11] Patent Number: 5,001,797

[45] Date of Patent: Mar. 26, 1991

[54] DEVICE FOR GUIDING LAMINAR ELEMENTS FOR PROCESSING, PARTICULARLY INTENDED FOR HIDE AND SYNTHETIC MATERIAL FOLDING MACHINES

[76] Inventors: Alberto Bocca, Via Podgora 44; Mario Pagani, Via Farini, 34, both of 27429 Vigevano (Pavia), Italy

[21] Appl. No.: 386,919

[22] Filed: Jul. 31, 1989

[30] Foreign Application Priority Data

Aug. 5, 1988 [IT] Italy ..... 21676 A/88

[51] Int. Cl.[5] ..... A43D 11/00; A43D 95/00

[52] U.S. Cl. ..... 12/55.1; 12/55

[58] Field of Search ..... 12/1 R, 55, 55.1

[56] References Cited

U.S. PATENT DOCUMENTS

| | | | |
|---|---|---|---|
| 2,231,874 | 2/1941 | Beatty | 12/55.1 |
| 2,311,085 | 2/1943 | Rudolph | 12/55 |
| 2,712,662 | 7/1955 | Naugler | 12/55.1 |
| 2,881,456 | 4/1959 | Agostino | 12/55 |
| 2,979,745 | 4/1961 | Schaefer, Jr. et al. | 12/55 |
| 3,088,144 | 5/1963 | Weeks | 12/55.1 |
| 3,121,242 | 2/1964 | Longval | 12/55.1 |
| 3,530,521 | 9/1970 | Bocca et al. | 12/55.1 |
| 4,557,787 | 12/1985 | Mansfield et al. | 12/1 R |
| 4,610,041 | 9/1986 | Yardley | 12/55 |

*Primary Examiner*—Steven N. Meyers

*Attorney, Agent, or Firm*—Browdy and Neimark

[57] ABSTRACT

The invention relates to a device for guiding laminar elements for processing, particularly intended for hide and synthetic material folding machines, which comprises a working element (15) having an active end (15*a*) engageable by contact with a laminar element (10) being processed, and supporting and drive means (11) for the working element (15) adapted to impart cyclic oscillations to the active end (15*a*) defining a path comprising a section (30) raised off the laminar element (10) and a section (31) of contact with that same laminar element (10), the contact section (31) extending along a predetermined feed direction of the laminar element (10).

6 Claims, 3 Drawing Sheets

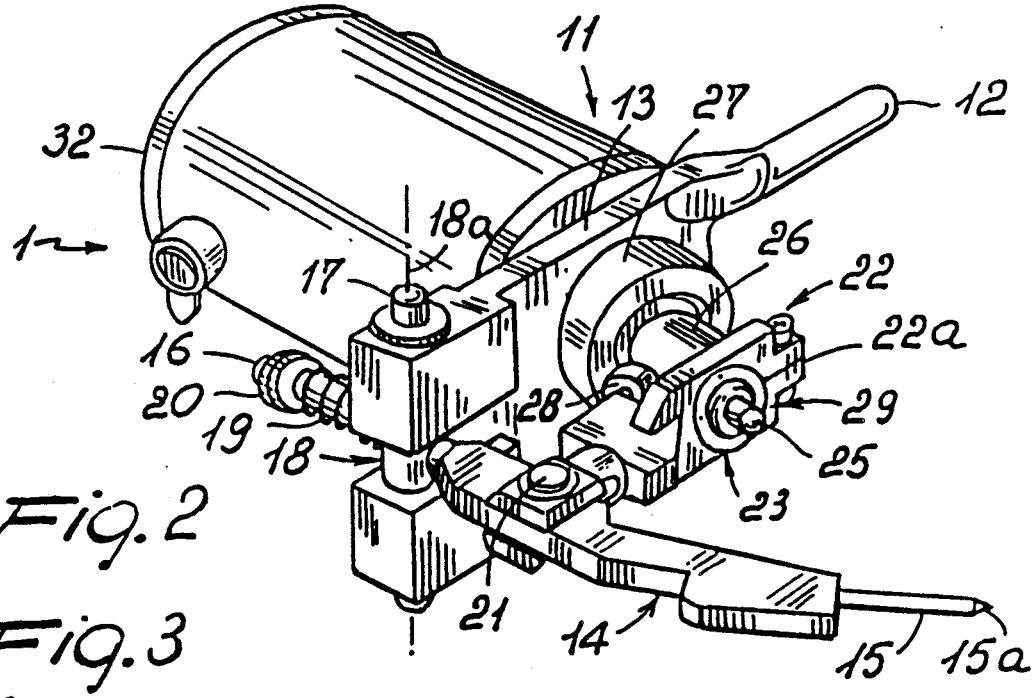
Fig. 2
Fig. 3
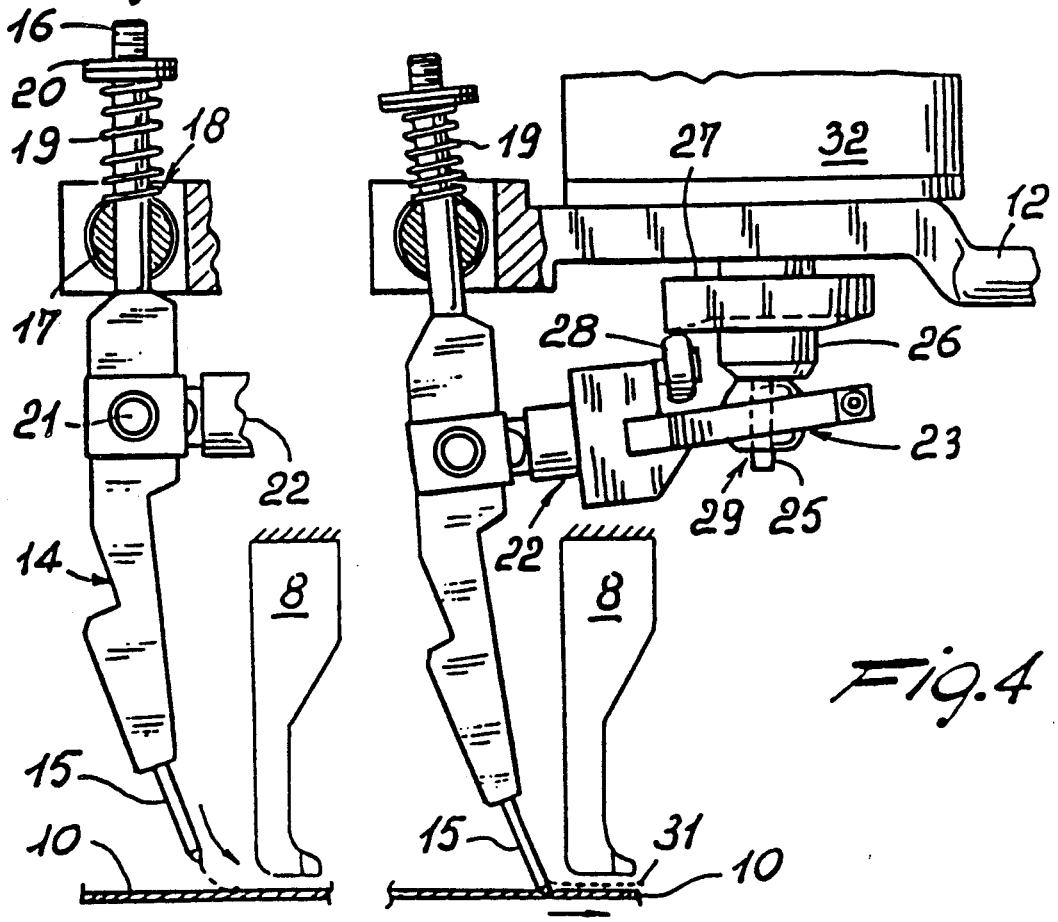
Fig. 4

DEVICE FOR GUIDING LAMINAR ELEMENTS FOR PROCESSING, PARTICULARLY INTENDED FOR HIDE AND SYNTHETIC MATERIAL FOLDING MACHINES

BACKGROUND OF THE INVENTION

This invention relates to a device for guiding laminar elements for processing, particularly intended for machines operative to fold up hides and synthetic materials, such as shoe uppers and insoles, leather articles.

It is known that hides and comparable laminar elements are in many cases to be folded and set in the folded position to provide folded over and well finished edges, for example. Particularly in the shoemaking industrywidely used and important are folding machines referred to as "thermocement folding machines" which work on hides and the like, as pre-arranged with fleshed and thinned edges, and are operative to both spread an adequate adhesive and to fold over and press the edges. The hide or the like is fed in an upside down position under members which dispense glue drops or beads onto the flat areas of the overturned hide onto which the folded over edges are then pressed and caused to adhere. The glue employed is a hot-melt type and is delivered through a line which extends as far as the bottom end of the so-called "shoe", formed by a rigid lug which shaves by its end the area of the hide or the like to be glued. Beneath the hide being processed, and aligned to the cited shoe, there is provided a "jaw" or movable clamping body which moves up periodically to clamp the hide or the like against said shoe. With the hide released, the same is advanced by an advance mechanism having two oscillating elements called the "anvil" and "hammer" which grab intermittently the hide and pull through a predetermined pitch distance. As soon as said anvil and hammer leave the hide the latter is clamped between said shoe and jaw. The edge upturning is effected by first pressing the hide or the like onto a guide having the shape of a small block with an arcuate face facing the cited shoe. The guide or small block causes initial raising and bending of the edges and the final fold is obtained by the pressing action applied by the anvil and hammer, which cause the folded over edges to adhere to the dispensed glue.

To facilitate the edge folding, especially in sharply bent areas, the folding machines also include severing members which subdivide the folded over edge into several small portions independent of one another.

On the work surface there are also provided various photocells which sense the shape of the workpiece and adjust accordingly the transport speed of the material being processed and the distance between the various edge cuts, which cuts are to be made the closer the sharper is the bend in the workpiece.

An essential condition to the proper operation of these machines is a correct position of the hide or synthetic material being processed at the cited small block.

This correct position may be either achieved in a substantially manual way, such as under the supervision and action of an operator, or in an automatic way, by means of purposely provided guiding devices.

Heretofore, manual and direct supervision of the process by an operator has been dominant over automatic monitoring, because the guiding devices provided heretofore have proved in many cases inadequate.

By way of example mention may be made of Italian patent No. 685886, and corresponding U.S. Pat. No. 3088144, wherein a device for guiding hides and the like is described which is based on the use of an advance wheel which operates uninterruptedly on the material being processed. The technical solution just mentioned, like all those based on roller guide or in any case geometrically well-defined elements, have the fundamental drawback of operating in an inflexible manner, that is to say, by applying a constant action which tends to move the hide or the like in a tightly constrained manner.

In this situation the guiding devices are to adjusted very accurately and yet they easily prove inadequate where the hides or the like being processed have very sharp bends or occasionally irregular shapes.

It should be also considered that a malfunction, however occasional, of these guiding devices has higly harmful consequences because it not only requires again an action from an operator but also that the guiding devices themselves be deactivated and the completed work be corrected. This to the point that in many cases the conventional guiding devices, even where available, are not used and manual supervision by the operators is used instead.

SUMMARY OF THE INVENTION

In this situation the technical task underlying this invention is to provide a device for guiding laminar elements for processing which can substantially remedy the drawbacks of currently known devices.

Within this technical task it is an important object of the invention to provide a particularly flexible and functional device, that is capable of adjusting itself to the different needs which are to be faced during the feeding of a laminar element into a processing zone, in particular during the feeding of a hide or the like into a folding machine.

Another important object of the invention is to provide a device having a simple construction and reduced cost, synchronizable in an immediate fashion with the processing phases of the machine to which it is applied and also readily retrofitted to existing folding machines on the market which have no guiding members. The outlined technical task and specified objects are substantially achieved, according to the invention, by a device for guiding laminar elements for processing, particularly intended for hide and synthetic material folding machines, which is characterized in that it comprises: a working element having an active end engageable by contact with said laminar element, and supporting and drive means for said working element adapted to impart cyclic oscillations to said active end which define a path comprising a raised section, raised off said laminar element, and a contact section, of contact with the same laminar element, said contact section extending along a predetermined feed direction of said laminar element.

BRIEF DESCRIPTION OF THE DRAWINGS

Further features and advantages will be apparent from the following description of preferred embodiments of the invention given with reference to the accompanying drawings, where:

FIG. 1 shows in elevation the device according to the invention as applied to a folding machine for uppers and the like;

FIG. 2 is a perspective bottom view of the device structure, shown in an isolated position; and FIGS. 3,4,5,6 and 7 show in succession how the device of this invention operates.

Detailed Description of the Invention

Figure 1:
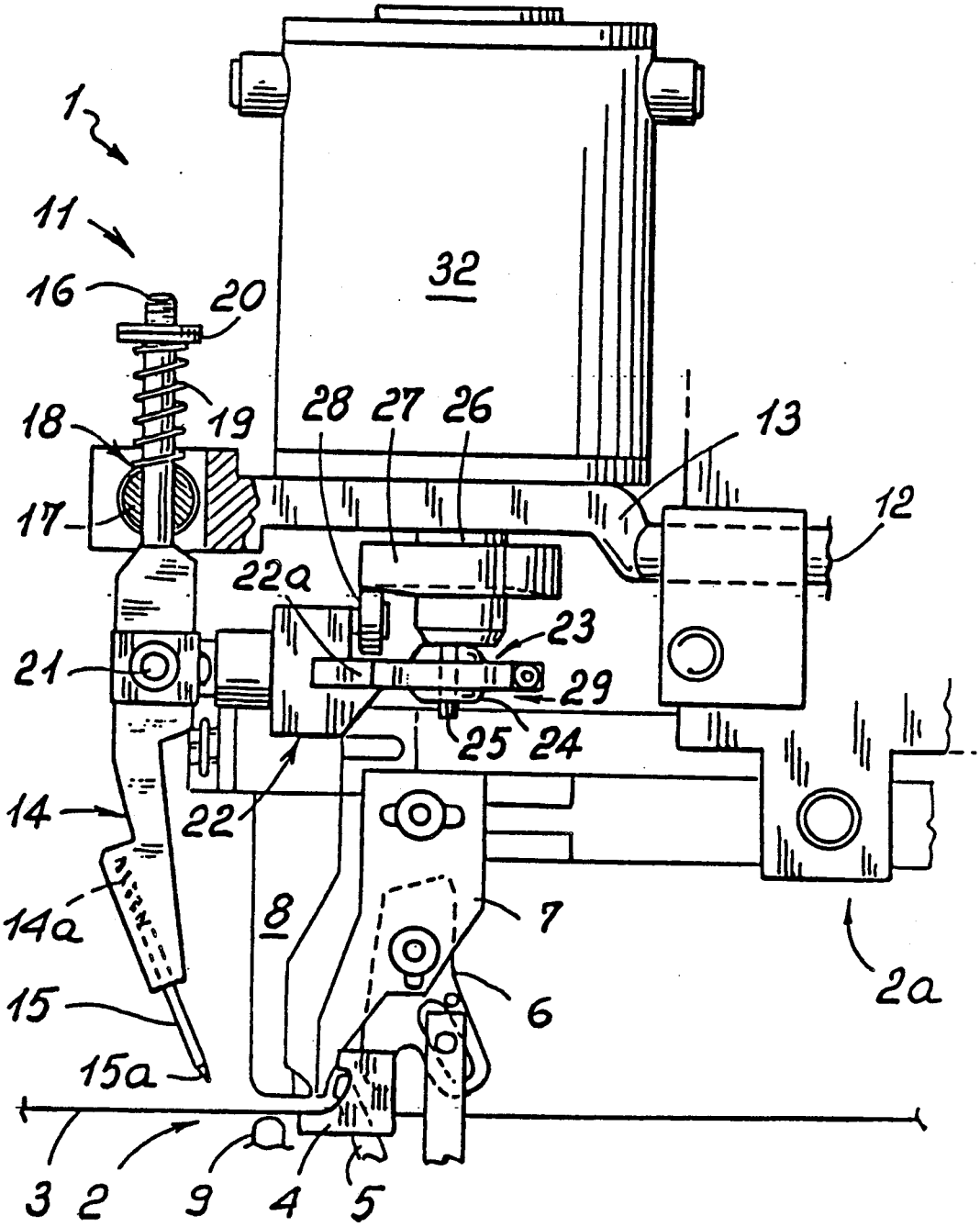

The device according to this invention is generally designated by the reference numeral 1. It is applied, in FIG. 1, to a folding machine 2 known per se, of which some operational members are shown schematically.

Shown in particular are a working surface 3, a guide or small block 4 on which initial bending of the edge to be folded over takes place, a folding finger 5 which acts after the guide 4, a knife 6 active against an anvil knife 7, and a shoe 8 placed close to the guide 4 and dispensing, from its bottom end, a hot-melt glue for securing the upturned edge.

A jaw 9, also known per se, is placed beneath the working surface 3 and moves cyclically upwards to engage a hide 10, or the like laminar element, against the base of the shoe 8.

In a folding machine 2 there are also provided members for cyclically advancing the hide or laminar element 10 in the form of a hammer and underlying anvil which clamp the upturned edge and cause it to adhere to the glue dispensed from the shoe 8. The hammer and anvil drive the hide 10 forward with the jaw 9, aligned to the shoe 8, disengaged from the shoe. The hammer and anvil are not shown because removed from the guide 4.

The guiding device 1 according to the invention is engaged with a frame 2a of the folding machine 2 and comprises supporting and drive means 11 for a working element 15 which is oscillable and in contact with the hide 10. In detail, the guiding device 1 is engaged with the frame 2a through a small shaft 12 substantially parallel to the working surface 3 and projecting cantilever-fashion, after the manner of an appendage, from a plate-shaped holder 13, to which the entire guiding device 1 is led. The small shaft 12 is adapted to allow the guiding device 1 to perform oscillations about the shaft 12 axis, substantially toward the cited hammer and anvil. The oscillations may be driven by members, not shown, such as cams and cam followers, and have the effect of assisting a concurrent movement of the hide 10 with that already imparted by said anvil and hammer.

However, if the action of said anvil and hammer is found sufficient, one can select of not swinging the device toward said anvil and hammer and the oscillations of the device may be inhibited by means of stops or by clamping the small shaft 12. The holder 13 engages, at a location removed from the small shaft 12, a bar-like body 14 which extends in a transverse direction to the working surface 3 until it terminates with the cited working element, formed by a small rod 15 also lying transversely to the working surface 3 and terminated with an active end 15a. In the example shown, the active end 15a is a single pointed end.

The small rod or working element 15 is oscillable axially against an elastic means 14a formed by a small compression spring housed inside the bar-like body 14.

The bar-like body 14 is engaged with the holder 13 by means of a first swivel connection 18 defined by a tang 16 in continuation of the bar-like body 14 and a first pin 17 substantially perpendicular to the tang 16 and substantially parallel to the working surface 3. The first pin 17 is penetrated slidably by the tang 16 and both the tang 16 and the first pin 17 have circular cross-sections, so as to permit of their rotation about respective axes.

In particular, the axis of rotation of the first pin 17 defines, in the first swivel connection 18, an axis of oscillation 18a of the bar-like body 14, whereas the axis of the tang 16 defines a lifting and lowering axis of the bar-like body 14.

Around the tang 16 a spring element 19 is wound which is formed by a compression spring closed between the first pin 17 and washers 20 fast with the tang 16.

Between the first swivel connection 18 and the small rod 15 the bar-like body 14 is engaged, at a second pin 21, by a crosspiece-like body 22 which flanks the holder 13 at a position away therefrom and is terminated with a small plate 22a engaged centrally by a second swivel connection 23. The second swivel connection 23 has a part-spherical bulb 24 penetrated by a pin 25. The latter extends transversely of the small plate 22a and forms an eccentric or cam 29 with the second swivel connection 23. In fact, the pin 25 is affixed and parallel, in an offcentered position, to a drive shaft 26 penetrating the holder 13 and being driven by an electric motor 32 preferably a DC motor.

Mounted to the drive shaft 26 is a face cam 27 acting on a cam follower 28 engaged with the crosspiece-like body 22. The cam follower 28 is a small wheel whose axis is substantially parallel to the main dimension of the crosspiece-like body 22. The cam 27 acts on the cam follower 28 against the elastic bias of the compression spring 19 fitted over the tang 16 of the bar-like body 14.

The cam 27 and the cam 29 defined by the pin 25 and second swivel connection 23 impart cyclic oscillations on the active end 15a which define a path having a raised section 30 and a contact section 31 off/with the hide 10, as shown in FIGS. 3 to 7.

The device operation will be now described with reference to the successive operational steps shown in FIGS. 3 to 7. As shown in FIG. 3, at the cycle start the bar-like body 14 is raised and vertical and the small rod 15 has its active end 15a raised off the hide 10 and relatively removed from the guide or small block 4 flanking the shoe 8. In this situation, coincident with that of FIG. 1, the cam follower 28 is in a fully raised position and the cam 29 has the pin 25 in the fully advanced position with respect to the bar-like body 14. As the drive shaft 26 is rotated the cam 27 will bring its outermost portion in the direction toward the working surface 3 (FIG. 4) to contact the cam follower 28 and force therefore the crosspiece-like body 22 to oscillate as a whole around the second swivel connection 23 to bring the second pin 21 and bar-like body 14 to a down position, thereby the active end 15a will engage the hide 10.

Figure 5:
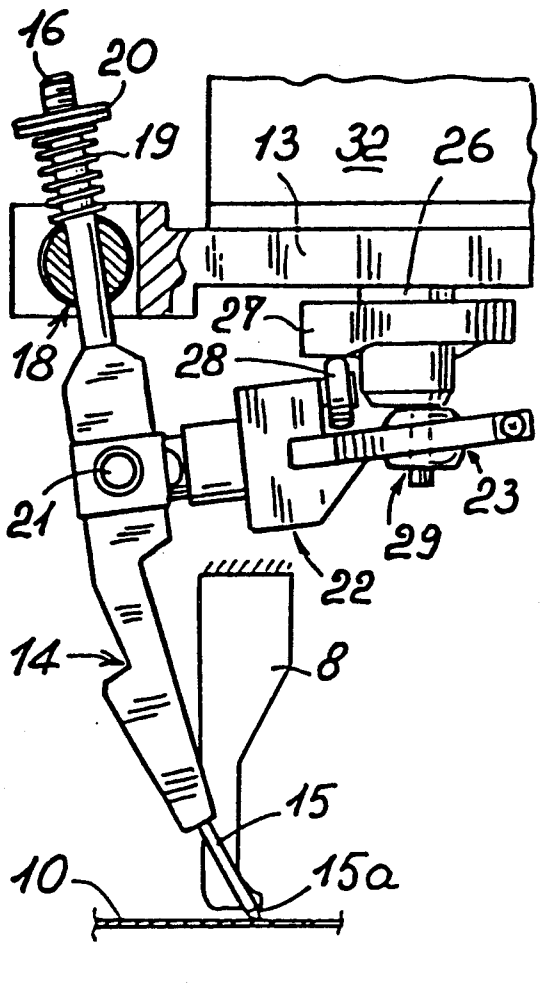

This downward movement of the active end 15a is performed against the compression spring 19, which is shown compressed in FIG. 4. The small rod 15 is slidable in the axial direction against an elastic means, and accordingly, slight irregularities of the device or the hide 10 would be accommodated by axial movements of the small rod. Thereafter, as shown in FIG. 5, with the cam 27 still in contact with the cam follower 28 through an outermost zone in the direction toward the working surface 3, and therefore with the small rod 15 held down, the cam 29 will come to a diametrically opposed position fully away from the bar-like body 14. Thus, the bar-like body 14 is caused to rotate around the first swivel connection 18 and in particular about the axis of the first pin 17. Thanks to this rotation the active end 15a of the small rod 15 will move forward to substantially flank, and possibly move past, the shoe 8 in the direction toward the guide 4.

This is the contact section 31 of the path travelled by the active end 15a, which contact section brings about an entrainment in its own right of the hide 10 in the direction toward the guide or small block 4, consistently with the requirements of this kind of machine. The contact of the active end 15*a* with the hide 10 is maintained at all times also on account of said axial mobility of the small rod 15.

Figure 6:
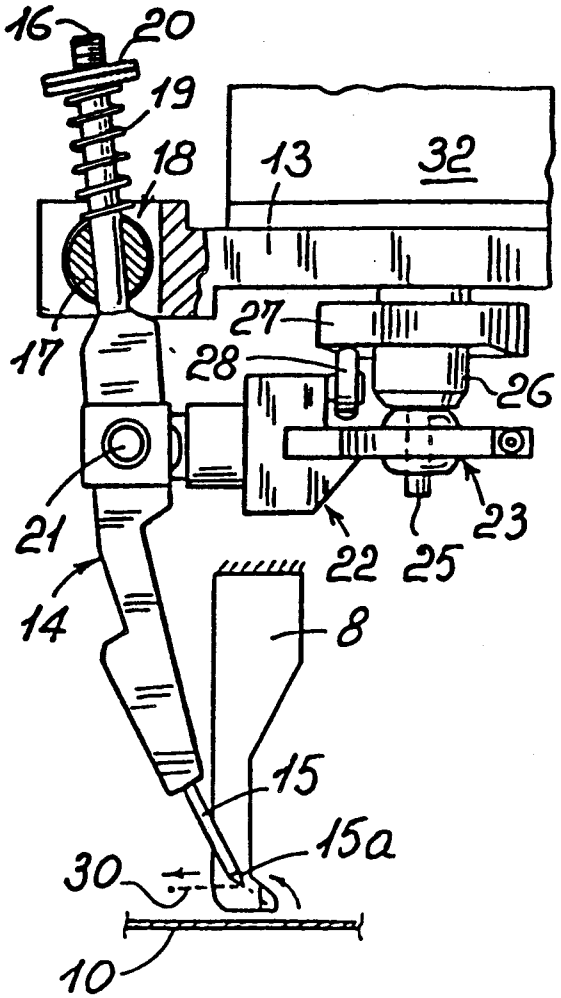

Subsequently, as shown in FIG. 6, there both occur an upward movement of the small rod 15 and a return movement thereof to the position of FIG. 3. In fact, further rotation of the cam will again bring the cam follower 28 to the raised position and the compression spring 19 will raise once again, by acting on the washers 20, both the bar-like body 14 and the crosspiece-like body 22, also entraining the small rod 15. Simultaneously, the cam 29 will gradually move the pin 25 back to a forward position and therefore oscillate the bar-like body 14 around the first swivel connection 18 away from the guide 4. During this step, the raised section 30 is completed which constitutes a return section to the original position.

Figure 7:
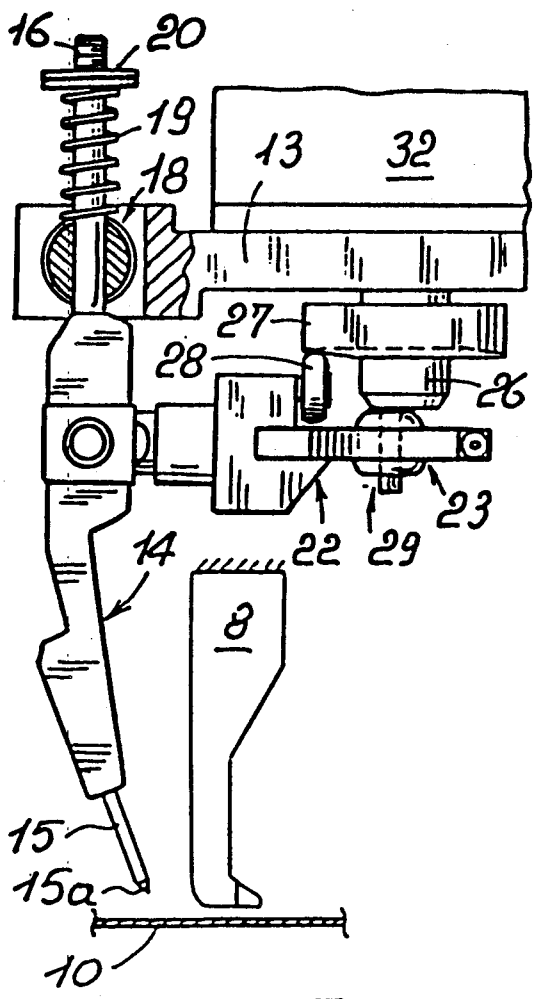

FIG. 7 is substantially coincident with FIG. 3 and shows the device return to the original position.

It is apparent from the foregoing discussion that an important features of the invention is the cyclic thrusting of the active end 15*a;* the thrust phases are followed by inactive phases where the hide or the like is allowed to partially relax. In this situation it becomes possible to drive during the thrust phase particularly enhanced forward movements adjusted to fit the most critical situations, for example, without introducing important disturbance of the hide movement. In fact the same when unstressed can relax onto the working surface into the most appropriate position.

Another important feature is the limited contact of the device with the hide being processed. This limited contact, being punctiform in the instance shown, causes the thrust from the active end 15*a* to impart no definite angular direction to the hide as may be inappropriate. The hide is merely pushed to a position against the working members of the machine and not forced out of its angular position. Therefore, it may even in this case adjust itself into the most appropriate angular position as defined by the working members engaging it.

It should be also noted that it is very easy and immediate to either increase or decrease the thrust action: it is sufficient that the rotational speed of the electric motor 32 be increased or decreased to relate it to the pitch of the severing members formed by the knife 6 and anvil knife 7.

As specified already, it is also possible to oscillate the device 1 about the axis of the small shaft 12 by introducing a parallel movement to the entrainment movement of the cited anvil and hammer. The invention is susceptible to many modifications and variations. For example, the assembly of the face cam 27 and cam follower 28, acting against the compression spring 19, may be replaced with a dual or desmodromic cam which allows elimination of the compression spring 19.

The active end 15*a* may be provided with both a point and small teeth set close together to bite less deeply into the hide or the like.

In the instance of guiding devices provided in conjunction with a folding machine, the electric motor 32 may be replaced with flexible mechanical linkages led to the motor of the folding machine and formed by belts and pulleys, for example.

We claim:

1. A device for guiding a laminar element for processing hide and synthetic material folding machines comprising:

a working element (15) having an active pointed end (15*a*) engageable by contact with said laminar element (10); and supporting a drive means (11) for said working element adapted to impart cyclic oscillations to said active end to define a path comprising a raised section (30) raised off of said laminar element and a contact section (31) in contact with said laminar element, said contact section extending along a predetermined feed direction of said laminar element;

wherein said supporting and drive means comprise: a holder, a bar- body extending in a transverse direction to said laminar element being processed and engaging said working element, and a first swivel connection interposed between said bar- body and said holder and defining an oscillation axis of said bar- body substantially parallel to said laminar element; said working element is a small rod extending transversely to said laminar element and wherein said active end is one end of said small rod; and wherein said device has an elastic means (14*a*) acting on said small rod in a direction toward said laminar element being processed, said elastic means being interposed between said small rod and said supporting and drive means.

2. A device according to claim 1, wherein said first swivel connection comprises a tang in continuation of said bar- body and a first pin slidably penetrated by said tang and pivotally engaged with said holder, said first pin having a pivot axis relative to said holder which coincides with said oscillation axis and said tang being slidable in said first pin against a spring element (19).

3. A device according to claim 1, wherein said holder comprises a small shaft extending from said holder and is substantially perpendicular to said oscillation axis of said first swivel connection, wherein said small shaft oscillably supports said holder.

4. A device according to claim 1, wherein said supporting and drive means further comprises a drive shaft penetrating said holder, a crosspiece- body (22) extending between said drive shaft and said bar body, a second pin and second swivel connection engaging said crosspiece- body with said bar- body, and said drive shaft.

5. A device according to claim 4, wherein said drive shaft is terminated with a pin penetrating said second swivel connection pivotally and being a continuation of said drive shaft in a shifted position from the axis of said drive shaft, said second swivel connection and said pin defining an eccentric.

6. A device according to claim 5, wherein a cam encircles the exterior of said drive shaft and engages with a cam follower engaged with said crosspiece body, said cam (27) and said cam follower being aligned transversely to said crosspiece- body.

* * * * *